US005827416A

United States Patent [19]

Brown et al.

[11] Patent Number: 5,827,416

[45] **Date of Patent: *Oct. 27, 1998**

[54] PROCESS FOR CONTROL OF ELECTRODEPOSITION UTILIZING CATHODIC AND ANODIC FLUSHABLE ELECTRODES

[76] Inventors: Sean M. Brown, 47 Rayburn Dr., Millbury, Mass. 01527; Francis J. Brady, 16 Throne Hill Rd., Groton, Mass. 01450; W. James Allshouse, 76 Stone Ridge Rd., Franklin, Mass. 02038

[ * ] Notice: This patent issued on a continued prosecution application filed under 37 CFR 1.53(d), and is subject to the twenty year patent term provisions of 35 U.S.C. 154(a)(2).

[21] Appl. No.: 718,954

[22] Filed: Sep. 26, 1996

[51] Int. Cl.[6] ..... C25D 13/00

[52] U.S. Cl. ..... 204/472; 204/481

[58] Field of Search ..... 204/472, 481

[56] References Cited

U.S. PATENT DOCUMENTS

| | | | |
|---|---|---|---|
| 3,630,870 | 12/1971 | Smith | 204/481 |
| 3,671,412 | 6/1972 | Lohr | 204/181 |
| 5,047,128 | 9/1991 | Hawkins et al. | 204/472 |
| 5,049,253 | 9/1991 | Izuo et al. | 204/301 |
| 5,078,850 | 1/1992 | Inoue | 204/282 |
| 5,507,929 | 4/1996 | Brochu et al. | 204/280 |

OTHER PUBLICATIONS

Doug McPheron, POWERCRON® News Update, dated Oct. 1995.

PPG Industries, Inc., Industrial Electrocoat POWERCRON® 590–534 Product Booklet, dated Aug. 22, 1995.

PPG Industries, Inc., Industrial Electrocoat POWERCRON® 590–534 Process Control, dated Aug. 25, 1995.

Koch Membrane Systems, Inc., EDCORE® Flushable Anodes, dated Jul. 1992.

*Primary Examiner*—Kathryn L. Gorgos
*Assistant Examiner*—Kishor Mayekar
*Attorney, Agent, or Firm*—Shook, Hardy & Bacon L.L.P.

[57] ABSTRACT

A process of controlling an ionic electrodeposition coating system is provided for a applying coating solution, which contains a solubilizer and ionic coating particles, to an object. A first flushable, tubular electrode is placed into the tank that is electrically charged and that is accessible by the solution through a correspondingly charged membrane. A second flushable, tubular electrode is also placed into the tank that is electrically charged corresponding to the first electrode and that is accessible by the solution through an oppositely charged membrane. The object to be coated is then supplied with an electrical charge, and the electrodes are supplied with an opposite electrical charge. The application of electrical current causes a portion of the ionic coating particles to be attracted to and deposited upon the object, and also causes a release of excess cations and anions. The ions that have a charge corresponding to the charge of the object are removed at the first electrode by allowing the ions to pass through its charged membrane. Further, the ions that have a charge opposite to the charge of the object are surprisingly attracted to the like-charged second electrode and are removed at the second electrode by allowing the ions to pass through its charged membrane. The excess cations and anions are then removed from the system by circulating an electrolyte solution through the flushable electrodes.

13 Claims, 1 Drawing Sheet

PROCESS FOR CONTROL OF ELECTRODEPOSITION UTILIZING CATHODIC AND ANODIC FLUSHABLE ELECTRODES

BACKGROUND OF THE INVENTION

The present invention relates to an electrodeposition coating process, and more specifically to a process for controlling the pH and electroconductivity levels of an electrodeposition solution while limiting the discharge of pollutants.

Electrodeposition is a process by which coatings are applied to the surface of an object by the action of an electrical current. The process utilizes an electrodeposition tank or bath filled with a cationic or anionic solution containing a coating to be deposited on the object, with the coating having a known degree of ionization allowing it to be affected by an electrical current. The object to be coated is placed into the solution in the tank and a source of electrical current is connected thereto. An electrode-type device is then placed in the solution in spaced relationship from the object and serves as an oppositely charged counterelectrode to the object. The electrical forces thus created cause the coating to be attracted to, and thereby deposited on, the object.

In electrodeposition painting processes, an anionic paint or cationic paint, composed mainly of a resin, is used in the form of an aqueous solution which also usually contains a solvent, such as butyl cellosolve. In anionic electrocoating processes, it is often necessary to add an alkali solubilizer to the ionic coating solution in order to adjust the electroconductivity thereof. In cationic electrocoating processes, it is often necessary to add an acidic solubilizer to adjust the electroconductivity of the solution. In the majority of anionic electrodeposition systems, the solubilizers used are organic amines, like diethanolamine or potassium hydroxide (KOH). In the cationic paint process, however, the solubilizers are primarily organic acids, such as lactic, acetic, sulfamic, or propionic acid. The difference between an anionic and a cationic electrochemical process for the deposition of paint depends on whether the part being coated is to be the anode or the cathode. In an anodic system the part is the anode and the counterelectrodes are the cathodes. Conversely, in the cathodic system the part is the cathode and the counterelectrodes are the anodes. The anodic technology was developed first and typically requires a lower bake temperature for the coated part. Further, anodic paint formulations are typically of lower cost than cathodic formulations and offer moderate corrosion protection. The anodic technology does, however, cause some part decomposition which can result in paint contamination. The cathodic technology, on the other hand, typically requires less part preparation and has excellent corrosion resistance. Further, the cathodic technology causes much less part decomposition.

Once the electrodeposition process has begun, ionic paint particles are deposited on the object to be coated. Therefore, a gradual build up of excess solubilizer is generated as the coating process continues, thus necessitating the removal of the excess solubilizer in order to maintain the proper paint chemistry.

In past electrodeposition systems, bare electrodes were placed into the paint tank. The coating solution in these systems would be passed through an ultrafiltration system which was coupled with the paint tank. Ultrafiltration is a pressure driven process for fractionating and concentrating solutions containing colloids and high-molecular-weight materials. A selective, semi-permeable membrane retains high-molecular-weight materials, such as paint resins, while allowing solvents and low-molecular-weight solutes to pass through. The coating solution is thus cycled through the ultrafiltration system, with the coating particles returning to the paint tank while a partial volume of the solubilizer, solvents and low molecular weight solutes are discharged to the sewer. This discharge is commonly referred to as UF permeate. Therefore, when bare electrodes are used with an ultrafiltration system, the excess solubilizer is removed by discharging a partial volume of the UF permeate to sewer. While the UF permeate contains the excess solubilizer, it also contains the solvent, which in the anionic paint is usually butyl cellosolve, and both anions and cations. Therefore, discharging the UF permeate to sewer acts to control the pH of the electrodeposition solution by discharging the excess solubilizer. Further, by discharging both anions and cations the electroconductivity of the tank is controlled.

Discharging the UF permeate to sewer is disadvantageous, however, because the solvent that is discharged is expensive and must be replaced, thus adding to the overall operating costs of the electrodeposition process. Further, some states have recently restricted the amount of solvent that can be discharged into the environment.

Therefore, a method is needed for simultaneously controlling the chemistry of the electrocoat paint processes using either anionic or cationic coating solutions while limiting the discharge of pollutants to the environment. Previous attempts to address this need included the use and construction of a reverse osmosis system and the use of flushable tubular cathodes. The reverse osmosis system is employed in series with the ultrafilter to capture the solvents in the UF permeate while allowing the excess solubilizers to pass through. The reverse osmosis system is disadvantageous due to high initial capital costs as well as additional operating costs, including the handling and recycling of concentrated solvents in significant volumes. The reverse osmosis system therefore proved too costly to operate, thus not efficiently addressing the above stated need.

Flushable tubular electrodes have also been used in an attempt to control the chemistry of the electrocoat paint process without discharging pollutants to the environment. When anionic paint is used, tubular flushable cathode cells replace the existing bare cathodes in the electrocoat tank. The tubular flushable cathode serves as both a counterpart electrode for the object which is to be coated or painted, and as a dialysis device for the removal of excess solubilizer from the solution. In these devices, the electrode is separated from the solution by a membrane generally surrounding at least a portion of the electrode and through which the solubilizer flows. The membrane used is an ion exchange/electrodialysis membrane made from a seamless polyolefinic polymer copolymerized with ion exchange resin. The ion exchange resin is ion selective and can be either anionic or cationic. For example, a flushable tubular electrode having a cationic membrane will reject anionic paint pigments, binders and the solvent, while allowing excess cations to pass freely through the membrane. A space is provided within the device between the membrane and the electrode for accumulation of the cations during filtration. Cations that pass through the membrane barrier are flushed from the area between the electrode and the membrane by an electrolyte fluid. This electrolyte fluid enters the device and flows first through the electrode, and then through the area between the electrode and the membrane. As the electrolyte solution flows within the device, it accumulates any excess cations which have been drawn through the membrane by the charge of the electrode. The electrolyte and filtrate mixture is removed from the device through an electrolyte discharge port. Thus, the pH of the electrodeposition solution is partially controlled by removing excess cations from the electrocoat tank.

Therefore, the above-described method does, to a degree, satisfy the objective of controlling the pH and conductivity of the electrodeposition solution without discharging pollutants to the environment. However, the use of flushable cathodes does not entirely solve the problem. For example, in the anionic paint system, the cationic membrane used on the flushable tubular cathode removes the excess cations from the electrocoat tank. The cationic membrane cannot, however, remove any anions from the tank. As the electrocoat process continues, therefore, the electroconductivity of the electrodeposition solution increases as a result of the build up of anions in the solution. Therefore, the ultrafiltration system is still needed to remove the anions from the solution to control the conductivity of the coating solution. As previously described, the UF permeate should not be discharged to the sewer. Therefore, the pH of the solution is controlled by removing cations, and the conductivity is controlled by removing both cations and anions. As stated above, however, the UF permeate contains an expensive solvent that must be replaced and whose discharge to the environment should be avoided. Therefore, the use of flushable tubular cathodes presented only a partial solution to the problem and still required handling of pollutants discharged by the process.

Therefore, a process is needed that can be used to control the pH and electroconductivity of the solution in an ionic electrocoat tank while significantly limiting, or eliminating, the discharge of pollutants to the environment.

SUMMARY OF THE INVENTION

It is therefore an object of the present invention to provide a process for use in an ionic electrodeposition system to control the pH and electroconductivity of the coating solution while limiting the discharge of pollutants to the environment.

It is another object of the invention to provide a process where the pH and electroconductivity of a coating solution in an electrodeposition system can be controlled using flushable electrodes having cationic membranes and flushable electrodes having anionic membranes.

It is a still further object of the present invention to remove the excess anions, cations and anionic solubilizer in an anionic electrodeposition system without discharging any anionic solubilizer or solvent to the environment.

It is still another object of the present invention to control the pollutants discharged to the environment in an anionic electrodeposition system using flushable electrodes having negatively charged cationic and anionic membranes.

It is a still further object of the present invention to remove the excess anions, cations and cationic solubilizer in a cationic electrodeposition system without discharging any cationic solubilizer or solvent to the environment.

It is still another object of the present invention to control the pollutants discharged to the environment in a cationic electrodeposition system using flushable electrodes having positively charged cationic and anionic membranes.

To accomplish these and other related objects of the invention an electrocoat application assembly is provided for controlling the pH and conductivity of an ionic coating solution. The assembly has a tank for containing the ionic coating solution with a primary and a secondary flushable tubular electrode assembly located within the tank. The primary and secondary electrode assemblies have an ionic membrane circumferentially surrounding an electrode. Means are provided for electrically coupling the electrodes to an electrical conduit, which places a similar charge on the primary and secondary electrodes. Further, the membrane of the primary electrode has a charge corresponding to the charge of the electrodes and the ionic membrane of the second electrode has a charge opposite the charge on the electrodes. An electrolyte circulation apparatus is provided for circulating an electrolyte solution through the first and second electrodes.

Further, a process of controlling an electrodeposition system is provided that uses flushable tubular electrodes placed into a tank containing a coating solution. The coating solution contains a solubilizer to adjust the electroconductivity and also contains ionic coating particles. A primary flushable, tubular electrode is placed into the tank that is electrically charged and that is accessible by the solution through a correspondingly charged first ionic membrane. A secondary flushable, tubular electrode is also placed into the tank, is charged with the same charge as the first electrode and is accessible by the solution through an oppositely charged membrane. The object to be coated is supplied with a charge opposite to that supplied to the electrodes and current is passed between the electrodes and the object. The charged coating particles are attracted to and deposited upon the object as current passes through the solution. The application of electrical current also results in a release of excess cations and anions. Next, the ions that have a charge corresponding to the charge applied to the object are attracted to the primary electrode and are allowed to pass through the charged membrane surrounding the primary electrode. The ions that have a charge opposite to the charge of the object are, surprisingly, attracted to the secondary electrode and are allowed to pass through the charged membrane. The excess cations and anions are then removed from the respective electrodes by circulating an electrolyte solution through the flushable electrodes.

DESCRIPTION OF THE DRAWING

In the accompanying drawings which form a part of the specification and are to be read in conjunction therewith and in which like reference numerals are used to indicate like parts in the various views.

DETAILED DESCRIPTION OF THE PREFERRED EMBODIMENTS

Figure 1:
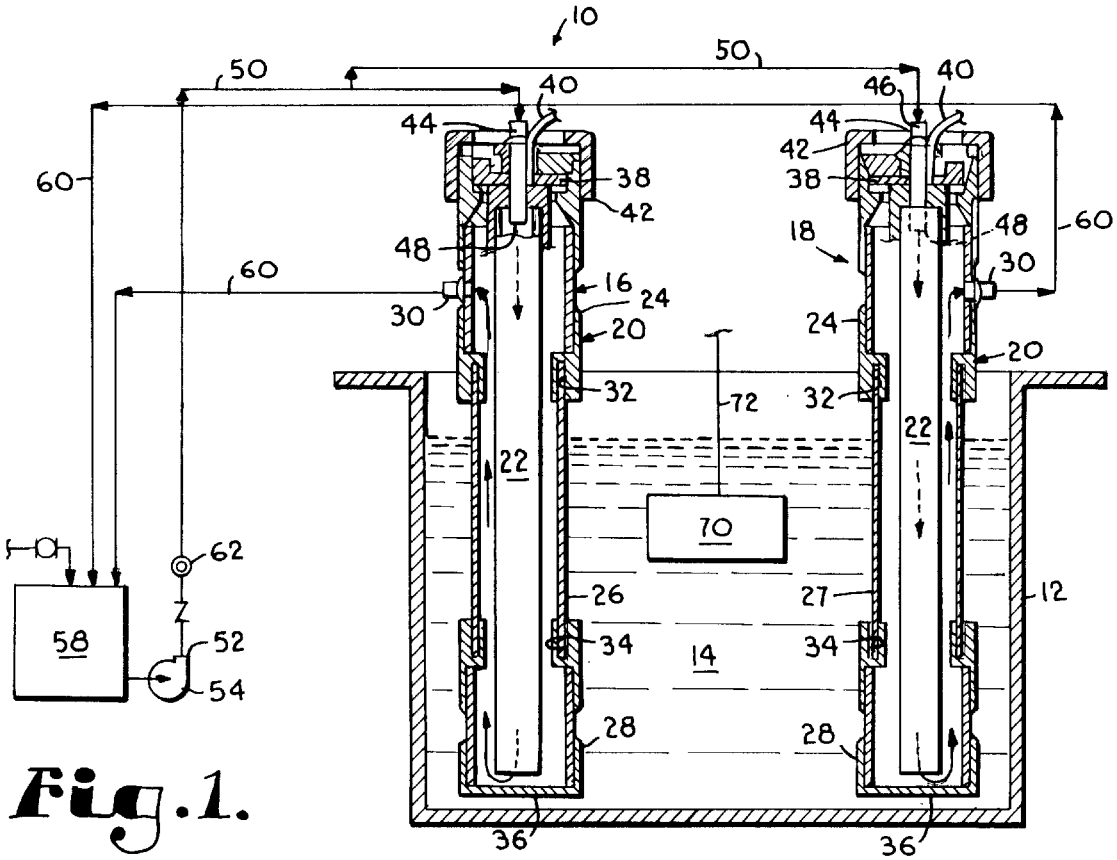
FIG. 1 is a schematic front elevation view of the electrocoat application assembly embodying the principles of this invention.

An electrocoat application assembly embodying the principals of this invention is broadly designated in the drawings by the reference numeral 10. Referring initially to FIG. 1, assembly 10 includes a tank 12 suitable for containing a coating solution 14. Coating solution 14 is either an anionic or cationic paint, composed primarily of a paint resin and an organic solvent such as cellosolve, in an aqueous solution, with an alkali or acid added thereto to adjust the electroconductivity. (Cellosolve is a registered trademark for a family of industrial solvents comprising mono- and dialkyl ethers of ethylene glycol and their derivatives.) Also placed partially within tank 12 are flushable tubular electrode assemblies 16 and 18. Most of the components of assemblies 16 and 18 are identical and like reference numerals will be used on these common components. Primary electrode assembly 16 includes an elongated tubular body 20 and an elongated electrode 22 disposed essentially concentrically within body 20.

Body 20 has upper and lower segments, 24 and 28 respectively, which are disposed in co-axial orientation with respect to each other. Upper segment 24 is a generally cylindrical tube is open on its top and bottom and which is made from PVC or other suitable plastic material. Further, upper segment 24 has a cylindrical fluid outlet 30 extending therefrom. Fluid outlet 30 provides access to the interior of upper section 24. Upper section 24 has disposed on its lower end a concentrically oriented connecting ring 32. Disposed in co-axial relation between upper segment 24 and lower segment 28 is a membrane 26 that circumferentially surrounds a portion of electrode 22. Membrane 26 is held at its upper end by a circumferential slot in a connecting ring 32. The lower end of the membrane 26 is held firmly in place by a corresponding connection ring 34 on the upper end of lower section 28. Membrane 26 is a seamless polyolefinic polymer copolymerized with an ion exchange resin. Membrane 26 is a cationic membrane, thus, allowing cations to pass therethrough, while retaining anionic paint particles and solvent anions from coating solution 14. Lower section 28 further has a bottom 36 that acts to seal body 20, thus, allowing penetration into the interior of body 20 solely through membrane 26 when electrode assembly 16 is partially submerged in coating solution 14. Lower section 28, similar to upper section 24, can be made of PVC or other suitable plastic material.

Therefore, upper section 24, membrane 26 and lower section 28 cooperate to form body 20. Body 20 has a generally open interior that is open on top and closed on the bottom. Disposed within the open interior of body 20 is an electrode 22. Electrode 22 is generally hollow and is positioned essentially concentrically within body 20 and spaced a predetermined distance from the bottom thereof. Further, a space is provided between electrode 22 and body 20. Electrode 22 is held within body 20 by an electrode cap 38 that is in turn held in position interiorly of upper section 24. Connected to electrode cap 38 is an electrical cable 40 that transmits electrical current electrode 22. Cable 40 is connected on its opposite end to a source of electrical current (not shown).

Disposed on top of upper section 24 and generally covering the opening thereof is an optional dust cover 42. Cover 42 operates to protect the interior of electrode assembly 16 and can form a liquid-tight seal with upper body segment 24. Cover 42 has an access port 44 on its upper end. Running through access port 44 is electrical cable 40 and a fluid inlet 46 that has a terminal end 48 generally located within the hollow interior of electrode 22.

The opposite end of fluid inlet 46 is in communication with a supply line 50. Supply line 50 is in fluid communication with an outlet 52 of an electrolyte pump 54 which in turn is in communication with an electrolyte tank 58. Finally, electrolyte tank 58 is supplied with recycled electrolyte via a recycle line 60 that is in fluid communication with fluid outlet 30.

A conductivity monitor 62 is coupled with supply line 50 for monitoring the conductivity of the electrolyte passing through the supply line, and a flow meter 63 is coupled with supply line 50 for monitoring the flow of electrolyte passing through the supply line. A feed line 64 is in fluid communication with tank 58 for supplying make-up deionized water (DI water), as more fully described below. Additionally, tank 58 has an overflow line 66 and a drain line 68 connected thereto, as best seen in FIG. 2.

Secondary electrode assembly 18 is identical in construction to electrode assembly 16 except for the provision of membrane 27 in place of membrane 26. Membrane 27 is an anionic ion-exchange membrane which allows anions to pass through the membrane while rejecting cations. Anionic membrane 27 rejects positively charged paint resin components and positively charged solubilizer components which remain in coating solution 14.

Figure 2:
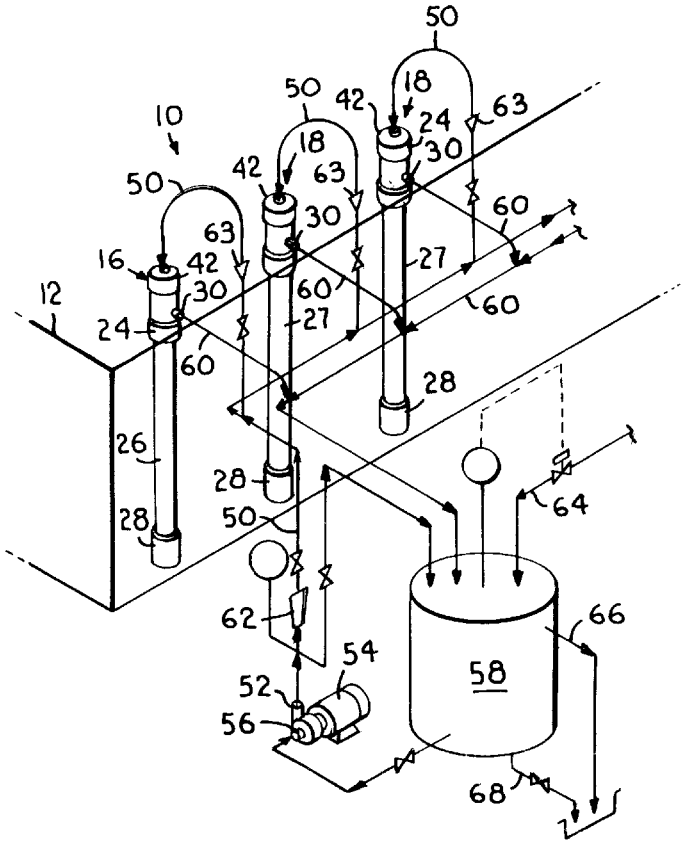
FIG. 2 is a schematic perspective view of the assembly of the present invention, showing more details of the electrolyte piping system.

A number of electrode assemblies 16 and 18 will normally be placed in either series or parallel within tank 12, as best seen in FIG. 2. When coating solution 14 contains anionic coating particles and anionic solubilizer, a greater number of primary electrode assemblies 16 are typically provided than secondary electrode assemblies 18. More specifically, it is preferred that the total area of electrode assemblies 16 equals approximately fifteen to twenty percent of the area of a part 70 that is to be coated and most preferably sixteen to seventeen percent. It is further preferred that the total area of electrode assemblies 18 in this environment equals three to five percent of the area of part 70. Similarly, when coating solution 14 contains cationic coating particles and cationic solubilizer, a greater number of primary electrode assemblies 16 are typically provided than electrode assemblies 18. More specifically, it is preferred that the total area of electrode assemblies 16 equals approximately fifteen to twenty percent of the area of part 70, most preferably sixteen to seventeen percent, and that the total area of electrode assemblies 18 equals three to five percent of the area of part 70.

In operation, electrocoat application assembly 10 is used to place a coating on an object 70. Object 70 has a mechanical conductor 72 connected thereto for supplying an electrical current to the object. Conductor 72 is typically a bussbar with contactor plates. In one embodiment of the invention, coating solution 14 comprises anionic coating particles. In this embodiment, a positive electrical charge will be supplied to object 70. Thus, object 70 will operate as the anode. In this embodiment, coating solution 14 will also include an anionic solubilizer, as well as a solvent, such as butyl Cellosolve (ethylene glycol monobutyl ether). The anionic solubilizer is usually an organic amine, such as diethanolamine. Potassium hydroxide may also be used as an anionic solubilizer. When object 70 is positively charged, electrodes 22 are given a negative charge. Thus, electrodes 22 are cathodes. When current is supplied to the system, the anionic coating particles will be attracted to object 70 and the cations from the coating solution will be attracted to electrodes 22. In additions to cations from the coating solution there is also a build up of anions from the solubilizer as the electrodeposition coating process continues. Because membrane 26 is cationic, it will allow excess cations to pass therethrough as they are attracted to electrode 22 of assembly 16. The excess cations that have passed through membrane 26 are retained in the space between electrode 22 and body 20 and are thereafter removed from this space by circulating an electrolyte through electrode assembly 16. When electrodes 22 are negatively charged, the electrolyte solution is a catalyte solution. The catalyte solution is pumped from electrolyte pump 54 through supply line 50 to fluid inlet 46. The catalyte enters the interior of electrode 22 and flows downwardly through electrode 22. The catalyte is then allowed to pass out of the bottom of electrode 22 and is pumped upwardly through the space between electrode 22 and body 20. As electrolyte is thus pumped through electrode assembly 16, it will eventually reach fluid outlet 30, whereupon it is returned through recycle line 60 to electrolyte tank 58. Thus, in this embodiment, electrode assembly 16 cooperates with the electrolyte circulation system to remove excess cations from tank 12. Therefore, electrode assembly 16 controls the pH of coating solution 14 by removing excess cations.

If only electrode assembly 16 was present within tank 12, as has been the case with prior known assemblies, the conductivity of coating solution 14 would still rise over time because the excess anions released from the anionic solubilizer are not removed. In the past, these anions were removed by discharging a portion of the permeate from the ultrafiltration system to the sewer, which in turn results in a discharge of dilute concentration pollutants in significant volumes to the environment. Surprisingly, it has been found that a second cathode provided with an anionic membrane is able to remove excess anions, thus eliminating the need for the discharge of permeate from the ultrafiltration system. Secondary electrode assembly 18 has a negatively charged cathode 22, which would normally attract only cations. Assembly 18, however, is provided with anionic membrane 27 which surrounds cathode 22. While the mechanism is not understood, it has been found that solubilizer anions will be attracted to the negatively charged electrode of assembly 18 and will, of course, pass through anionic membrane 27. These anions will collect in body 20 of assembly 18. The excess anions which accumulate in electrode assembly 18 are removed from tank 12 in a similar manner to that described above for removing cations at electrode assembly 16. More specifically, catalyte solution is pumped from electrolyte pump 54 through supply line 50 and electrode 22 using the same electrolyte circulation system. The catalyte solution then passes through the space between body 20 and electrode 22 and eventually through fluid outlet 30. The catalyte leaves fluid outlet 30 and enters recycle line 60 which returns the electrolyte to tank 58. Therefore, by placing both electrode assemblies 16 and 18 in tank 12, excess solubilizer anions as well as excess cations are removed and the pH and the electroconductivity of coating solution 14 can be controlled without discharging any ultrafilter permeate to the sewer, or at least significantly reducing both the volume and chemical concentration of any discharge of the ultrafilter permeate to the sewer.

Referring to FIG. 2, the electroconductivity of the electrolyte passing through supply line 50 is monitored by conductivity monitor 62. If the electroconductivity of the electrolyte reaches a maximum desired value, a fresh supply of electrolyte is added to electrolyte tank 58 through feed line 64. As fresh DI water is added, an overflow line 66 discharges the concentrated electrolyte solution that cannot be handled by tank 58. This process continues until the electroconductivity of the electrolyte has fallen to within ten percent of the maximum value. The discharge of electrolyte to sewer is not, at this time, harmful to the environment because, unlike the use of an ultrafiltration system, only minute levels of solvent at significantly reduced volumes are present in the discharged electrolyte. The majority of solvent is thus retained within tank 12 because membranes 26 and 27 do not allow it to pass through.

In another embodiment of the invention, coating solution 14 contains a cationic resin coating. In this embodiment, object 70 becomes the cathode and is negatively charged and electrodes 22 are the positively charged anodes. Also, in this embodiment primary electrode assembly 16 is provided with an anionic membrane and secondary electrode assembly 18 is provided with a cationic membrane. Both electrode assemblies have positively charged anodes 22. When current is supplied to coating solution 14, positively charged coating particles are deposited on object 70. Solution 14 will further contain a cathodic solubilizer that, in most instances, is an organic acid such as lactic acid, acetic, sulfamic, or propionic acid. As the coating process continues in this environment, excess solubilizer cations are released along with excess anions from the coating solution. The excess anions generated by the coating process are attracted to primary electrode assembly 16 and pass through anionic membrane 26 under the influence of anode 22. Once the excess anions have passed through membrane 26, they are flushed from the area by pumping electrolyte through assembly 16 and back into recycle line 60. When electrodes 22 are positively charged, the electrolyte is an anolyte. Therefore, excess anions are removed from the system.

Excess cations have not yet been removed from coating solution 14. If the excess cations are allowed to remain within coating solution 14 the buildup of cations will cause the conductivity of the tank to increase over time. In the past, the excess cations were removed by discharging some ultrafilter permeate to the sewer, resulting in a discharge of pollutants to the environment. In this embodiment of the present invention, however, secondary electrode assembly 18 is utilized to remove excess cations from coating solution 14. Secondary electrode assembly 18 has a positively charged anode 22, which would normally attract only anions. Assembly 18, however, is provided with cationic membrane 27 which surrounds anode 22. While the mechanism is not understood, it has been found that the solubilizer cations will be attracted to the positively charged electrode of assembly 18 and will, of course, pass through cationic membrane 27. These cations will collect in body 20 of assembly 18. The excess cations which accumulate in electrode assembly 18 are removed from tank 12 in a similar manner to that described above for removing anions at electrode assembly 16. Anolyte solution is pumped from electrolyte pump 54 through supply line 50 and electrode 22 using the same electrolyte system. The anolyte then passes through the space between body 20 and electrode 22 and eventually through fluid outlet 30. Upon leaving fluid outlet 30 the anolyte enters recycle line 60 which returns the electrolyte to tank 58. Therefore, by placing both electrode assemblies 16 and 18 in tank 12, excess solubilizer anions as well as excess cations are removed and the pH and the electroconductivity of coating solution 14 can be controlled without discharging any pollutants to the environment, or at least significantly reducing the discharge of any pollutants to the environment.

The invention also encompasses an electrocoating process for placing a coating on an object. The object desired to be coated is thus placed into a tank containing a coating solution comprising ionic coating particles and a conductive solvent. A primary flushable, tubular electrode that is electrically charged and accessible by the solution through a correspondingly charged membrane is placed into the tank. A secondary flushable, tubular electrode that is electrically charged in corresponding fashion to the primary electrode and that is accessible by the solution through an oppositely charged membrane is also placed into the tank. An electrical current is then applied to the object to be coated, and an opposite electrical charge is applied to the electrodes.

When anionic paint is used, a positive charge is applied to the object and a negative charge is applied to the electrodes.

The membrane surrounding the primary electrode is a cationic membrane and the membrane surrounding the secondary electrode is an anionic membrane. The application of electrical current causes a portion of the anionic coating particles to be attracted to and deposited upon the object, as oppositely charged cations are released. Further, solubilizer anions are released. The cations released by the coating solution are attracted to the primary electrode due to its negative charge. The cations are allowed to pass through the cationic membrane surrounding the primary electrode. These excess cations are then removed from the area by circulating an electrolyte solution through the area between the electrode and the membrane. The electrolyte solution is then returned to an electrolyte storage tank.

Next, the solubilizer anions are removed by the secondary electrode. The anions are attracted to the secondary electrode even though a negative charge is applied to the electrode. The anions are, of course, allowed to pass through the anionic membrane surrounding the secondary electrode. The anions are then removed from the area by circulating an electrolyte solution through the area between the secondary electrode and the membrane. The electrolyte solution is then returned to the same storage tank that supplies the primary electrode with electrolyte. Thus, both excess cations and anions are removed from the coating solution thereby controlling both the pH and conductivity of the coating solution.

The electroconductivity of electrolyte in the storage tank is monitored as the process continues. If the electroconductivity of the electrolyte reaches a maximum desired value, electrolyte is added to the storage tank until the conductivity of the electrolyte falls to an acceptable level.

While not restricting the invention to any particular theory, the ability of secondary electrode 18 to attract particles having the same, rather than the opposite, charge as the electrode itself is believed to be attributable to characteristics of the coating solution which "bind" or otherwise surround the solubilizer particles with other charged particles so the solubilizer anions or cations, as the case may be, actually take on sufficient characteristics of the opposite charge to be attracted to a like charged electrode. Differences in osmotic pressure on opposite sides of the electrolyte resin may also be a factor in causing ions to pass through the membrane to the like charged electrode.

In addition to greatly reducing or even eliminating the need to dispose of permeate from a separate ultrafiltration system, the present invention reduces the cost of electrodeposition coating by recycling essentially all of the electrolyte solution.

From the foregoing, it will be seen that this invention is one well adapted to obtain all the ends and objects hereinabove set forth together with other advantages which are obvious and which are inherent to the structure. It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. An electrocoating process comprising:

placing an object to be coated into a tank containing a coating solution comprising ionic coating particles placing a first flushable, tubular electrode having a given surface area into said tank, said first electrode being electrically charged and accessible by said solution through a membrane directly separating said first electrode and said solution and having a charge corresponding to the charge on said first electrode;

placing a second flushable, tubular electrode having a given surface area into said tank, said second electrode being electrically charged to correspond with the charge on the first electrode and accessible by said solution through a membrane directly separating said first electrode and said solution and having a charge opposite to the charge on said first and second electrodes;

applying an electrical current to said object and said electrodes to charge said object oppositely to said electrodes, said electrodes and said oppositely charged object cooperating to cause a portion of said ionic coating particles to be attracted to and deposited upon the object, said application of electrical current releasing first and second ions in the solution, said ions comprising cations and anions;

removing said first ions having a charge corresponding to the charge on said object at said first electrode, said charged membrane of said first electrode allowing passage of said first ions;

removing said second ions having a charge opposite to the charge on said object at said second electrode, said charged membrane of said second electrode allowing passage of said second ions;

flushing said first electrode with an electrolyte solution, having a measurable conductivity and pH, to remove said first ions; and flushing said second electrode with said electrolyte solution to remove said second ions;

such that the pH and electroconductivity of said solution is controlled by removing excess anions and cations released during electrodeposition.

2. The process of claim 1, further comprising:

calculating a maximum desired conductivity level for said electrolyte solution;

monitoring the conductivity of said electrolyte solution; and adding an amount of deionized water to said electrolyte solution when said electrolyte solution has a conductivity equal to or greater than said desired maximum, to lower the conductivity of said electrolyte solution to ten percent of said desired maximum.

3. The process of claim 1, wherein a greater number of said first electrodes are placed in said tank than said second electrodes.

4. The process of claim 3, wherein the surface area of said first electrodes is approximately 15 to 20 percent of the surface area of said object to be coated.

5. The process of claim 4, wherein the surface area of said second electrodes is approximately 3 to 5 percent of the surface area of said object to be coated.

6. The process of claim 1, wherein said coating solution is an anionic coating solution that contains an anionic solubilizer, wherein said first and second electrodes are negatively charged and said object is positively charged, and wherein said application of electrical current frees an excess amount of coating cations and an excess amount of solubilizer anions.

7. The process of claim 6, further comprising removing said excess solubilizer anions at said second electrode, said charged membrane of said second electrode allowing passage of said anions, and removing said excess coating cations at said first electrode, said charged membrane of said first electrode allowing passage of said cations.

8. The process of claim 7, wherein said flushing of said second electrode with said electrolyte solution removes said excess solubilizer anions and said flushing of said first electrode with said electrolyte solution removes said coating cations, to control the pH and electroconductivity of the solution.

9. The process of claim 8, wherein said electrolyte solution is a catalyte solution.

10. The process of claim 1, wherein said ionic coating solution is a cationic coating solution that contains a cathodic solubilizer, wherein said first and second electrodes are positively charged and said object is negatively charged, and wherein said application of electrical current frees an excess amount of coating anions and solubilizer cations.

11. The process of claim 10, further comprising removing said excess solubilizer cations at said second electrode, said charged membrane of said second electrode allowing passage of said cations, and removing said excess coating anions at said first electrode, said charged membrane of said first electrode allowing passage of said anions.

12. The process of claim 11, wherein said flushing of said second electrode with said electrolyte solution removes said excess solubilizer cations and said flushing of said first electrode with said electrolyte solution removes said coating anions, to control the pH and electroconductivity of the solution.

13. The process of claim 12 wherein said electrolyte solution is an anolyte solution.

* * * * *